US008958711B2

(12) United States Patent
Tanaka

(10) Patent No.: US 8,958,711 B2
(45) Date of Patent: Feb. 17, 2015

(54) IMAGE FORMING APPARATUS

(71) Applicant: Konica Minolta, Inc., Chiyoda-ku (JP)

(72) Inventor: Yu Tanaka, Hachioji (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 71 days.

(21) Appl. No.: 13/868,494

(22) Filed: Apr. 23, 2013

(65) Prior Publication Data

US 2013/0279933 A1 Oct. 24, 2013

(30) Foreign Application Priority Data

Apr. 24, 2012 (JP) ..... 2012-098685

(51) Int. Cl.
*G03G 15/20* (2006.01)

(52) U.S. Cl.
CPC ..... *G03G 15/2078* (2013.01); *G03G 15/205* (2013.01)
USPC ..... 399/70; 399/69

(58) Field of Classification Search
CPC ..... G03G 15/205; G03G 15/2003; G03G 15/2078
USPC ..... 399/69, 70
See application file for complete search history.

(56) References Cited

U.S. PATENT DOCUMENTS

| | | | | |
|---|---|---|---|---|
| 2010/0196037 | A1 | 8/2010 | Yasuda et al. | |
| 2011/0262159 | A1 * | 10/2011 | Takeuchi et al. | 399/44 |
| 2012/0141155 | A1 * | 6/2012 | Suzumi | 399/70 |

FOREIGN PATENT DOCUMENTS

| | | | |
|---|---|---|---|
| JP | 04-007583 | | 1/1992 |
| JP | 2001-201897 | | 7/2001 |
| JP | 2002-139952 | A | 5/2002 |
| JP | 2003-241566 | A | 8/2003 |
| JP | 2003-345173 | A | 12/2003 |
| JP | 2004-151502 | A | 5/2004 |
| JP | 2007-65413 | A | 3/2007 |

(Continued)

OTHER PUBLICATIONS

Notice of Reasons for Refusal issued in corresponding Japanese Patent Application No. 2012-098685, mailed Aug. 5, 2014, and English translation.

(Continued)

*Primary Examiner* — Hoang Ngo
(74) *Attorney, Agent, or Firm* — Buchanan Ingersoll & Rooney PC

(57) ABSTRACT

An image forming apparatus includes a non-contact temperature sensor that commences measuring temperature of a heating member in a fixing device once a waiting period of a certain length has passed after power supply commences to the fixing device, and acquires information indicating a heating condition of the heating member when the fixing device transitions to a non-power supplied state. Once the waiting period has passed, the apparatus controls to increase the heating member temperature to a target temperature, while monitoring the heating member temperature using the non-contact temperature sensor. During the waiting period, the apparatus estimates the heating member temperature at a present time using the information, and controls to increase the heating member temperature when the estimated temperature does not exceed a threshold temperature, and prevent increase of the heating member temperature when the estimated temperature exceeds the threshold temperature.

7 Claims, 10 Drawing Sheets

(56) References Cited

FOREIGN PATENT DOCUMENTS

| | | | |
|---|---|---|---|
| JP | 2007-171535 | A | 7/2007 |
| JP | 2009-156968 | A | 7/2009 |
| JP | 2010-181513 | A | 8/2010 |

OTHER PUBLICATIONS

Japanese Office Action (Decision to Grant a Patent) issued on Oct. 28, 2014, by the Japanese Patent Office in corresponding Japanese Patent Application No. 2012-098685 with an English translation thereof. (3 pgs).

* cited by examiner

FIG. 6

| Temperature range | Temperature decrease rate |
|---|---|
| 150°C-220°C | 2°C/s |
| 130°C-149°C | 1°C/s |
| 100°C-129°C | 0.5°C/s |
| 25°C-99°C | 0.1°C/s |

FIG. 7

| Temperature range | Power supply | Temperature increase rate |
|---|---|---|
| ≥ 150°C | 200 W | 1°C/s |
| | 500 W | 3°C/s |
| | 800 W | 10°C/s |
| | 1200 W | 20°C/s |
| 100°C-149°C | 200 W | 5°C/s |
| | 500 W | 10°C/s |
| | 800 W | 20°C/s |
| | 1200 W | 25°C/s |
| ≤ 99°C | 200 W | 8°C/s |
| | 500 W | 15°C/s |
| | 800 W | 25°C/s |
| | 1200 W | 30°C/s |

FIG. 8

| Detection time | Detected temperature |
|---|---|
| 2011/12/22 19:36:30 | 180°C |

IMAGE FORMING APPARATUS

This application is based on an application No. 2012-98685 filed in Japan, the contents of which are hereby incorporated by reference.

BACKGROUND OF THE INVENTION (1) Field of the Invention

The present invention relates to an image forming apparatus, such as a printer or a photocopier, which includes a fixing device. In particular the present invention relates to an art of controlling, during start-up of the fixing device, increase of temperature of a heating member used for thermal fixing.

(2) Description of the Related Art

An image forming apparatus, such as a printer or a photocopier, includes a fixing device for performing thermal fixing of an unfixed image formed on a recording sheet. In order that the fixing device can perform the thermal fixing, a warming-up period is required for a heating member in the fixing device to reach a predetermined target temperature (for example 190° C.).

A warming-up operation of the fixing device may commence from various different temperature conditions of the heating member. For example, if the image forming apparatus has been left for a long period with a power supply thereto set to Off or is in sleep mode, when the warming-up operation commences the heating member may have a low temperature close to room temperature. In contrast, if the power supply to the image forming apparatus is set to Off straight after completing a printing operation or a troubleshooting operation (for example of a paper jam), and then set to On again soon after, when the warming-up operation commences the heating member may have a high temperature close to the target temperature.

Consequently, in order to ensure that a heating amount of the heating member during the warming-up operation is not excessive or insufficient, control of the heating amount during the warming-up operation is performed based on the temperature condition of the fixing device while monitoring surface temperature of the heating member using a temperature sensor. If temperature of the heating member exceeds the target temperature then electrical power (hereinafter simply referred to as "power") is unnecessarily consumed, and thermal degradation of configuration elements of the fixing device such as the heating member and the temperature sensor is increased, thus reducing life-span thereof. However, the slower the increase of temperature of the heating member, the longer the warming-up period becomes, and thus the longer a waiting period which a user must wait for printing to be performed becomes.

As the temperature sensor, a contact temperature sensor which is in contact with the surface of the heating member, or a non-contact temperature sensor which is not in contact with the surface of the heating member may be used.

A contact temperature sensor is cheaper than a non-contact temperature sensor, but has a disadvantage that contact with the heating member causes friction between the contact temperature sensor and the surface of the heating member, reducing life-span thereof. Another disadvantage is that if toner becomes attached to a part of the surface contacting with the contact temperature sensor, surface temperature of the heating member may be detected through the toner, thus causing a deviation of the detected surface temperature from actual surface temperature of the heating member. In recent years, as a result of the above disadvantages, use of a non-contact temperature sensor, such as thermopile, to detect surface temperature of a heating member has become common (for example refer to Japanese Patent Publication No. 2002-139952).

Once the warming-up operation commences, control of the heating amount of the heating member is performed while monitoring temperature of the heating member using the non-contact temperature sensor, so that the temperature of the heating member does not exceed the target temperature. Specifically, in the above control a heating operation of the heating member is performed when the temperature of the heating member is lower than the target temperature, and the heating operation is suspended when the temperature of the heating member reaches the target temperature. Through the above control, the surface temperature of the heating member can be controlled to increase to the target temperature during the warming-up operation, without the heating amount of the heating member being excessive or insufficient.

On the other hand, the non-contact temperature sensor has a disadvantage as described below. The non-contact temperature sensor is easily influenced by ambient temperature around the non-contact temperature sensor. Therefore, when the ambient temperature is unstable, temperature of the heating member detected by the non-contact temperature sensor may deviate from actual temperature of the heating member. Thus, the disadvantage of the non-contact temperature sensor is that the non-contact temperature sensor cannot accurately measure temperature of the heating member while the ambient temperature is unstable.

The ambient temperature is particularly likely to be unstable when the fixing device transitions from a non-power supplied state to a power supplied state. The above is due to complex air currents being easily created in the image forming apparatus when power supply commences. The complex air currents are induced by operation of a fan for example, and cause instability of the ambient temperature.

As a consequence of the above, even if power supply commences to the fixing device, conventionally control of the heating amount of the heating member is commenced after a waiting period of a certain length (one second for example) has passed and the ambient temperature is stabilized.

Therefore, if control of the heating amount of the heating member is commenced after the waiting period has passed as described above, the warming-up operation of the heating member is delayed by an amount of time equivalent to the waiting period. The above causes a disadvantageous effect of length of a printing waiting period being increased. Alternatively, heating of the heating member could be commenced during the waiting period. However, if the heating member has a temperature close to the target temperature, the above causes a disadvantageous effect of the heating member being excessively heated so as to exceed the target temperature.

SUMMARY OF THE INVENTION

In order to solve the above problem, one aspect of the present invention is an image forming apparatus, comprising: a fixing device configured to thermally fix, through use of a heating member, an unfixed image formed on a recording sheet; a non-contact temperature sensor configured to commence measuring temperature of the heating member once a waiting period of a certain length has passed after power supply commences to the fixing device; an acquiring unit configured to each time the fixing device transitions to a non-power supplied state, acquire information indicating a heating condition of the heating member at the time the fixing device transitions to the non-power supplied state; and a fixing control unit configured to perform a non-waiting period control once the waiting period has passed and a waiting period control during the waiting period, the non-waiting period control being controlling to increase temperature of the heating member, while monitoring temperature of the heating member using the non-contact temperature sensor, until a target temperature is reached at which thermal fixing can be performed, and the waiting period control being estimating temperature of the heating member at a present time using most recent information acquired by the acquiring unit, and when the estimated temperature does not exceed a threshold temperature, controlling to increase temperature of the heating member, and when the estimated temperature exceeds the threshold temperature, controlling to prevent increase of temperature of the heating member.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6 shows one example of a temperature decrease rate specifying table;

FIG. 7 shows one example of a temperature increase rate specifying table;

FIG. 8 shows one example of temperature estimation information;

DESCRIPTION OF THE PREFERRED EMBODIMENTS

The following describes an embodiment of an image forming apparatus which is one aspect of the present invention. The embodiment is explained using an example of the present invention being applied to a tandem digital color printer (referred to below simply as a printer).

[1] Printer Configuration

Figure 1:
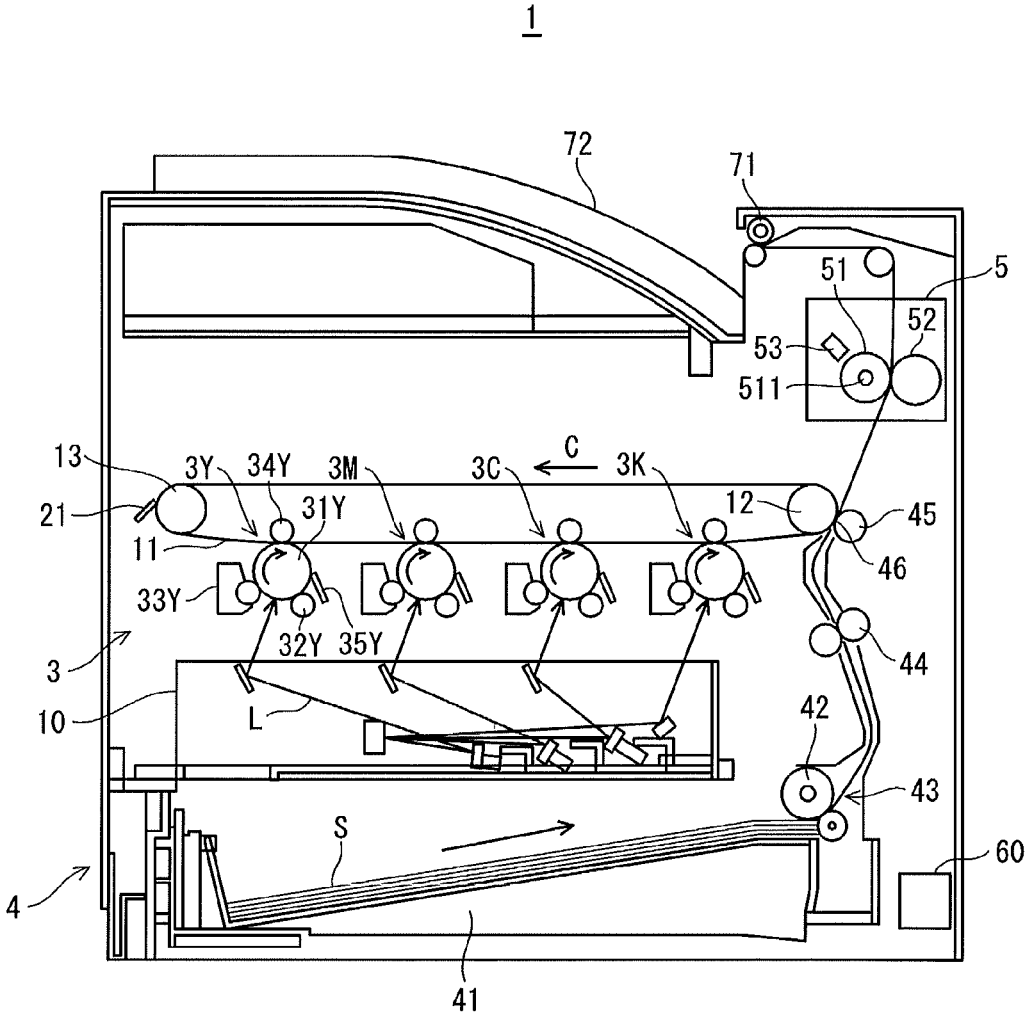
FIG. 1 shows configuration of a printer 1.

Firstly configuration of a printer 1 relating to the present embodiment is explained. FIG. 1 shows configuration of the printer 1. As shown in FIG. 1, the printer 1 includes an image processing unit 3, a sheet feeder 4, a fixing device 5 and a control unit 60. The printer 1 is connected to a network, for example a LAN (Local Area Network), and can receive a printing instruction from an external terminal device (not illustrated) or from an operation panel having a display unit (not illustrated). Based on the printing instruction, the printer 1 performs a printing operation on a recording sheet by forming a toner image using yellow, magenta, cyan and black colors, and transferring the toner image to the recording sheet by multi-layer transfer to form a full-color image. Below the colors yellow, magenta, cyan and black are referred to simply using letters Y, M, C and K respectively, and for each configuration element relating to one of the above colors the corresponding letter Y, M, C or K is added to the reference number for the configuration element.

The image processing unit 3 includes image creating sub-units 3Y, 3M, 3C and 3K, an exposing sub-unit 10, an intermediate transfer belt 11 and a secondary transfer roller 45. The image creating sub-units 3Y, 3M, 3C and 3K each have the same structure, therefore the following mainly describes structure of the image creating sub-unit 3Y.

The image creating sub-unit 3Y includes a photoconductive drum 31Y, and also includes a charger 32Y, a developer 33Y, a primary transfer roller 34Y and a cleaner 35Y, which are positioned peripherally around the photoconductive drum 31Y. The cleaner 35Y is provided for cleaning the photoconductive drum 31Y. The image creating sub-unit 3Y forms a Y color toner image on the photoconductive drum 31Y. The developer 33Y is positioned facing the photoconductive drum 31Y, and conveys charged toner thereto. The intermediate transfer belt 11 is an endless belt which is wound around a driving roller 12 and a driven roller 13 in a taut condition, and which is cyclically driven in a direction shown by arrow C in FIG. 1. The driving roller 12 is rotationally driven by a drive motor (omitted in FIG. 1). A cleaner 21 is provided at a position close to the driven roller 13 in order to remove residual toner on the intermediate transfer belt 11.

The exposing sub-unit 10 includes light emitting elements such as laser diodes. In response to a drive signal from the control unit 60, the exposing sub-unit 10 emits laser beams L for forming Y, M, C and K color images, to expose-scan the photoconductive drums of the image creating sub-units 3Y, 3M, 3C and 3K. Through the expose-scanning of the laser beams L, an electrostatic latent image is formed on the photoconductive drum 31Y, charged by the charger 32Y. An electrostatic latent image is formed in the same way on the photoconductive drums of each of the image creating sub-units 3M, 3C and 3K.

The electrostatic latent images formed on the photoconductive drums of the image creating sub-units 3Y, 3M, 3C and 3K are developed by the corresponding developers to form Y, M, C and K color images on the corresponding photoconductive drums. During primary transfer, the toner images formed in the image creating sub-units 3Y, 3M, 3C and 3K are transferred onto the intermediate transfer belt 11 by the corresponding primary transfer rollers of the image creating sub-units 3Y, 3M, 3C and 3K (note that in FIG. 1 only the primary transfer roller 34Y of the image creating sub-unit 3Y is given a reference symbol and reference symbols of the other primary transfer rollers are omitted). In the process of primary transfer, the toner images are transferred onto precisely the same position on the surface of the intermediate transfer belt 11 with appropriately adjusted timing. Subsequently, the toner images on the intermediate transfer belt 11 are completely transferred to the recording sheet during secondary transfer due to electrostatic energy from the secondary transfer roller 45.

After the toner image is transferred to the recording sheet in secondary transfer, the recording sheet is conveyed to the fixing device 5. The toner image (unfixed image) on the recording sheet is thermally fixed in the fixing device 5 by heating and pressurizing. After thermal fixing of the toner image, the recording sheet is ejected by an ejection roller 71 onto an ejection tray 72.

The sheet feeder 4 includes a feeding cassette 41 for stacking of recording sheets (indicated by reference symbol S in FIG. 1), pick-up rollers 42 which pick-up recording sheets stacked in the feeding cassette 41 one at a time and convey the picked-up recording sheet along a conveyance path 43 and timing rollers 44 which adjust the timing for conveying the picked-up recording sheet to a secondary transfer position 46.

Alternatively, the sheet feeder 4 may include a plurality of feeding cassettes. Paper sheets of various sizes and thicknesses (such as normal paper or cardboard) or film sheets such as OHP sheets may be used for the recording sheets. If the sheet feeder 4 includes a plurality of feeding cassettes, each of the feeding cassettes may be used for stacking of a different type of recording sheet in terms of size, thickness or material.

The timing rollers 44 convey the recording sheet to the secondary transfer position 46 at a time which coincides with a time at which the toner images, formed from the Y, M, C and K toner images and transferred onto the intermediate transfer belt 11 in primary transfer, are conveyed to the secondary transfer position 46 by the intermediate transfer belt 11. During secondary transfer, the toner images on the transfer belt 11 are completely transferred onto the recording sheet at the secondary transfer position 46 by the secondary transfer roller 45.

The pick-up rollers 42 and the timing rollers 44 have a drive motor (not illustrated) as a source of driving force, and are rotationally driven via a drive transmission mechanism (not illustrated) such as a gear or a belt. The drive motor may for example be a stepper motor capable of high precision control of rotational speed.

The fixing device 5 includes a heating roller 51, a pressing roller 52 which presses against the heating roller 51 forming a fixing nip, and a temperature sensor 53 which is positioned close to an outer circumferential surface of the heating roller 51 and which detects surface temperature of the outer circumferential surface.

A heater 511 (for example a halogen heater lamp) is positioned internally within the heating roller 51. An engine control unit (explained in detail further below) controls surface temperature of the heating roller 51 to a predetermined temperature by switching the heater 511 between On and Off.

Figure 2:
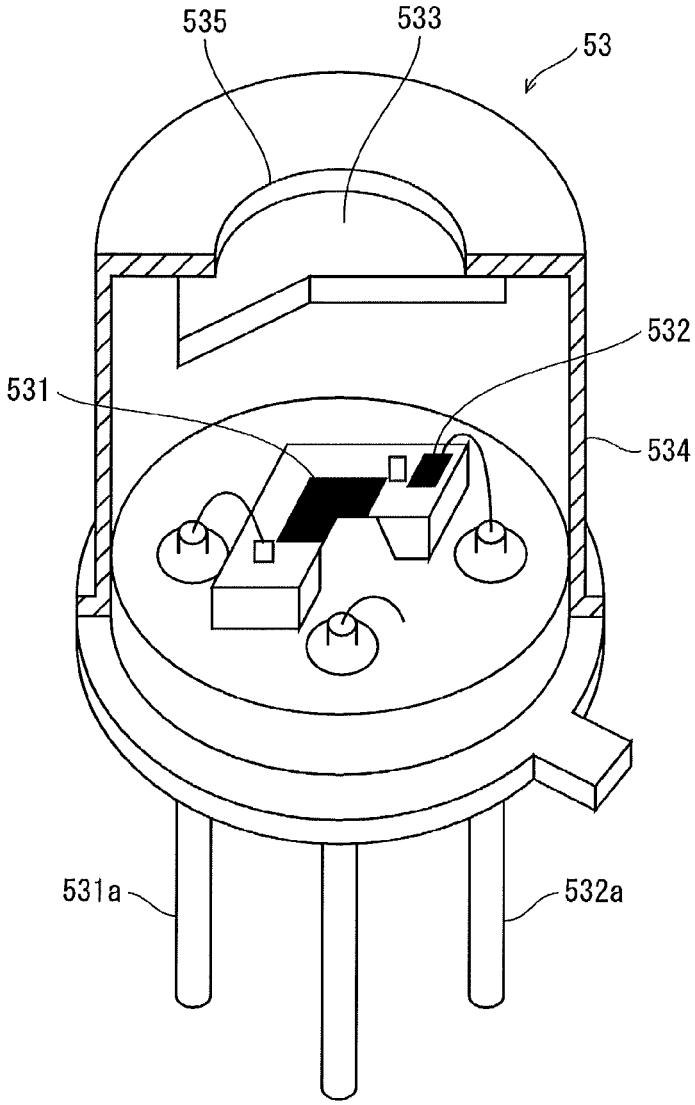
FIG. 2 is a perspective diagram showing structure of a temperature sensor 53.

The temperature sensor 53 is a non-contact temperature sensor and may for example be a thermopile, a non-contact thermistor, or an NC sensor (a sensor that detects temperature of a detection target using a first thermistor that detects infra-red rays radiated by the target and a second thermistor that detects peripheral temperature). In the present embodiment a thermopile is used as the non-contact temperature sensor. FIG. 2 is a perspective diagram showing structure of the temperature sensor 53.

The temperature sensor 53 includes a thermopile element 531, a thermistor 532, a condensing lens 533 which receives infra-red rays radiated by the heating roller 51, a casing 534 which houses the thermopile element 531 and the thermistor 532, and a window 535. An output terminal 531*a* of the thermopile element 531 and an output terminal 532*a* of the thermistor 532, protrude out of a rear surface of the casing 534.

The thermopile element 531 includes a plurality of thermocouples. Each of the thermocouples has a hot junction receiving radiated infra-red rays and producing heat, and a cold junction not producing heat. The thermopile element 531 outputs a voltage corresponding to a temperature difference between the hot junction and the cold junction, from the output terminal 531*a*.

Also, the thermistor 532 detects temperature of the cold junction and outputs a voltage corresponding to the detected temperature from the output terminal 532*a*. The condensing lens 533 is shaped so as to block the window 535. Size and positioning of the condensing lens 533 is set so as to receive infra-red rays radiated from a predetermined region on the surface of the heating roller 51. An infra-red pass filter (not illustrated) is provided in a pathway of light passing from the condensing lens 533 towards the thermopile element 531. The infra-red pass filter is configured to only allow light in a wavelength band corresponding to infra-red to reach the thermopile element 531. The infra-red pass filter is formed from a material which is transparent to infra-red rays, for example polyethylene resin or silicon resin. Alternatively, an infra-red pass lens may be used instead of the infra-red pass filter. For example, a silicon lens may be used for the infra-red pass lens.

An output voltage E of the thermopile element 531 is defined relative to a surface temperature $T_x$ of the heating roller 51, which is a target for temperature measurement, and a temperature $T_y$ of the temperature sensor 53 (temperature detected by the thermistor 532) as in the following equation.

$$E=A(T_x^4-T_y^4)$$

In the above equation A is a constant. By measuring the output voltage E and the temperature $T_y$ and then performing a calculation using the above equation, the surface temperature $T_x$ of the heating roller 51 can be calculated.

The temperature sensor 53 is a non-contact temperature sensor and thus is easily influenced by ambient temperature around the temperature sensor 53. Consequently, when the ambient temperature is unstable, temperature detected by the temperature sensor 53 deviates from actual temperature of the heating roller 51, and thus surface temperature of the heating roller 51 cannot be accurately measured using the temperature sensor 53.

In particular, when power supply commences to the fixing device 5, complex air currents are created in the printer 1, for example by operation of a fan. The air currents cause instability of the ambient temperature. Therefore, a time period of a certain length after power supply to the fixing device 5 commences is set as a waiting period, during which a detection operation of surface temperature of the heating roller 51 using the temperature sensor 53 is suspended. The detection operation commences once the waiting period has passed. In the present embodiment the waiting period is set as 1000 milliseconds.

[2] Power Supply System Outline

Figure 3:
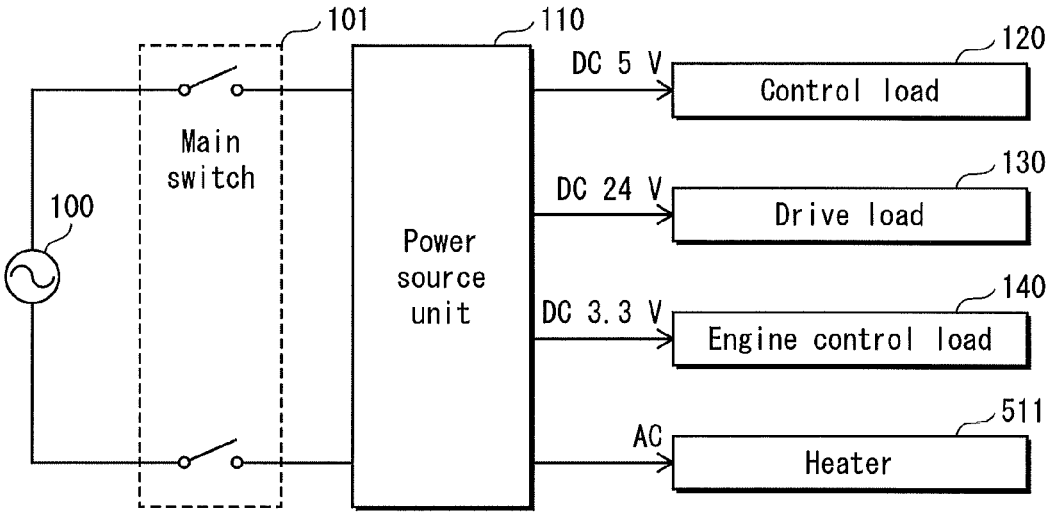
FIG. 3 shows an outline of a power supply system for supplying power to the printer 1.

FIG. 3 shows an outline of a power supply system for supplying power to the printer 1. When a main switch 101 is set to On, power is supplied from a mains power source (AC power source) 100, to a power source unit 110. The power source unit 110 converts the supplied AC power source to a DC power source, and creates a 5 V DC power source. The power source unit 110 supplies the 5 V DC power source to a control load 120 relating to a control system, which includes the control unit 60 and the operation panel for example.

The control unit 60 is started-up by supply of the 5 V DC power source from the power source unit 110. Subsequently, the control unit 60 causes the power source unit 110 to create a 24 V DC power source and a 3.3 V DC power source. The 24 V power source is supplied to a drive load 130, relating to a driving system, and the 3.3 V power source is supplied to an engine control load 140, relating to an engine control system. The control unit 60 causes the power source unit 110 to supply an AC power source to the heater 511. Through the above operation, power supply commences to the fixing device 5.

The drive load 130 includes for example an image reader, the temperature sensor 53, a fixing device drive motor which causes rotational drive of the pressing roller 52 in the fixing device 5, a fan motor which causes rotational drive of the fan, the image processing unit 3, and the sheet feeder 4. The engine control load 140 includes for example an engine control unit which controls an image formation operation. The image reader, the fixing device drive motor, the fan motor and the engine control unit are described in more detail further below.

Once the engine control unit is started-up by supply of the 3.3 V DC power source from the power source unit 110, the engine control unit commences temperature control of the heater 511.

[3] Processing Up Until Fixing Device Heater Control Commences

Figure 4:
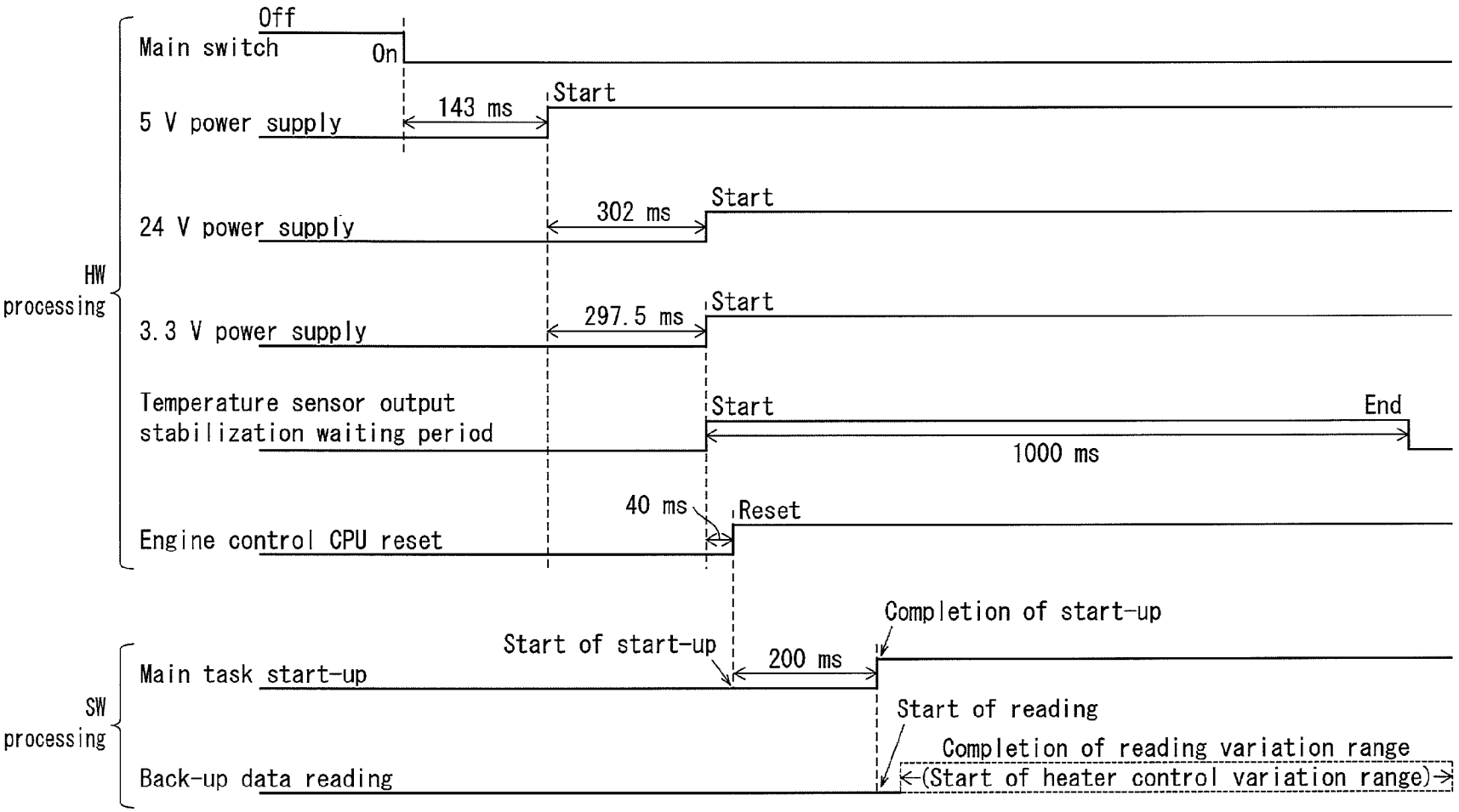
FIG. 4 shows an example of a time chart for processing performed in the printer 1 in a time period between a main switch 101 being set to On and temperature control of a heater 511 commencing.

FIG. 4 shows an example of a time chart for processing performed in the printer 1 between the main switch 101 being set to On and temperature control of the heater 511 commencing. In FIG. 4 "HW processing" and "SW processing" represent hardware processing and software processing respectively. As shown in FIG. 4, the power source unit 110 commences supply of the 5 V DC power source to the control load 120, 143 milliseconds after the main switch 101 is set to On, thereby causing start-up of the control unit 60.

The control unit 60 causes the power source unit 110 to create the 24 V DC power source and the 3.3 V DC power source. The 24 V DC power source is supplied to the drive load 130 and the 3.3 V DC power source is supplied to the engine control load 140. Supply of the 24 V DC power source commences 302 milliseconds after supply of the 5 V DC power source commences. Supply of the 3.3 V DC power source commences 297.5 milliseconds after supply of the 5 V DC power source commences.

The temperature sensor 53 is started-up when supply of the 24V DC power source starts to the drive load 130, however the fan for example is also started-up simultaneously. Therefore, the detection operation of surface temperature of the heating roller 51 by the temperature sensor 53 is suspended for a time period of a certain length from power supply commencing to the fixing device, until the ambient temperature around the temperature sensor 53 and the output voltage from the temperature sensor 53 stabilize (1000 milliseconds in the present embodiment). The above time period is referred to below simply as a "stabilization waiting period".

A reset operation of a CPU of the engine control unit (explained in detail further below) commences when supply of the 3.3 V DC power source starts to the engine control load 140. Once the reset operation is completed (the reset operation is completed 40 milliseconds after the reset operation commences in the present embodiment), a program is read for temperature control of the heater 511 and start-up of a main task commences. Once start-up of the main task is completed (start-up is completed 200 milliseconds after the start-up commences in the present embodiment), reading of back-up data by the CPU of the engine control unit commences. Once the reading of the back-up data is completed, temperature control of the heater 511 by the engine control unit commences.

As shown by the "Completion of reading variation range" in FIG. 4, an amount of time required for reading of the back-up data varies in response to an amount of back-up data. Back-up data may be added, deleted or changed by a person in charge of maintenance of the printer 1. Also, if the power source is cut-off during writing of back-up data due to an error or the like, the amount time required for reading of the back-up data is longer than compared to when an error does not occur. The above is due to deletion processing being performed the next time reading of the back-up data commences in order to delete the written region. For example, if an error does not occur, reading of the back-up data may be completed on a scale of tens to hundreds of milliseconds, but if an error occurs reading of the back-up data may in some cases require close to four seconds (3800 milliseconds) before completion.

As described above, an amount of time from power supply commencing to the fixing device to the engine control unit commencing temperature control of the heater 511 is variable based on the length of time required for reading of the back-up data. Therefore, at a time when reading of the back-up data is completed, the stabilization waiting period may or may not have passed.

[4] Control Unit Configuration

Figure 5:
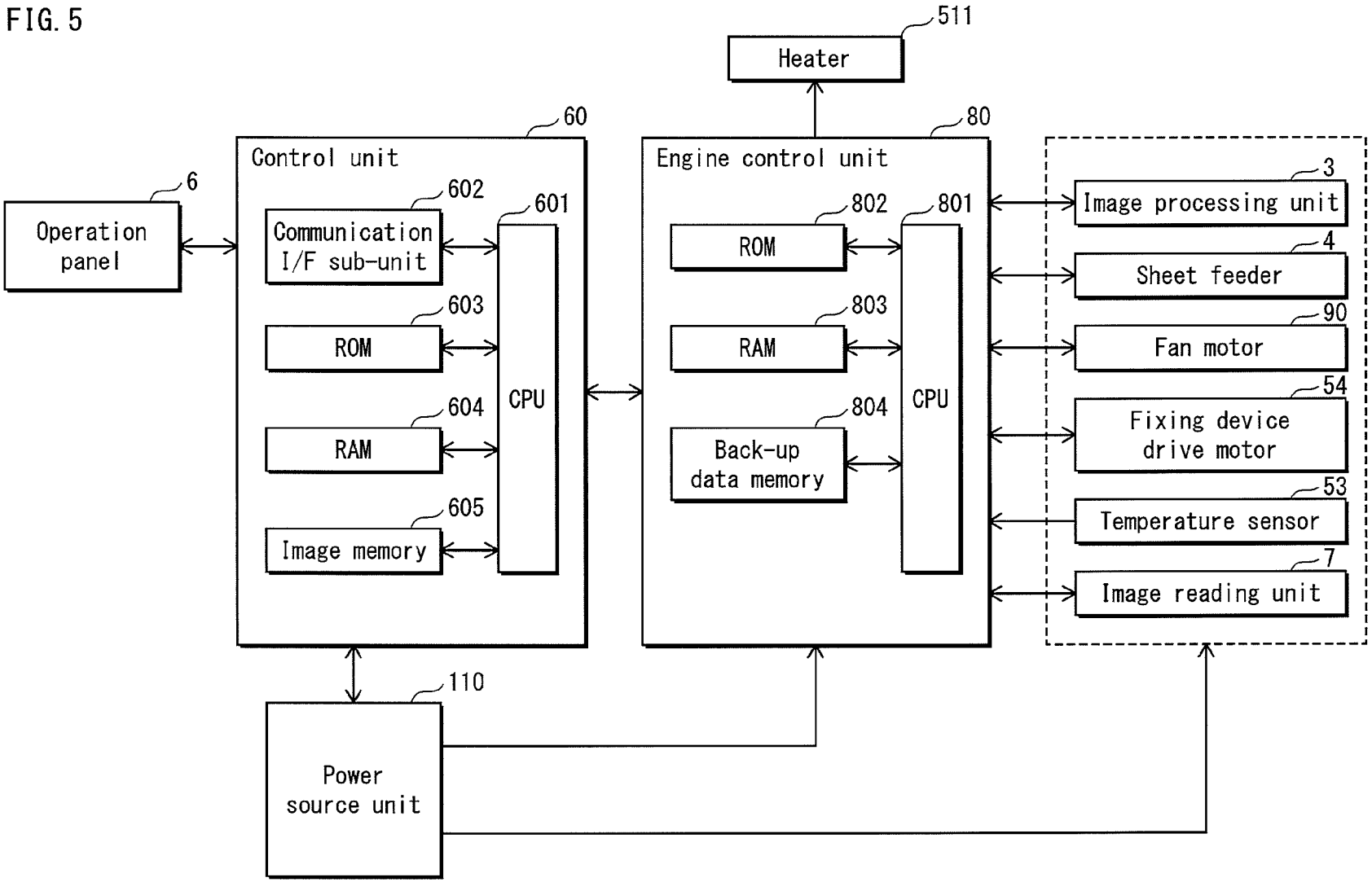
FIG. 5 shows configuration of a control unit 60 and relationship between the control unit 60 and main configuration elements that are controlled thereby.

FIG. 5 shows configuration of the control unit 60 and relationship between the control unit 60 and main configuration elements that are controlled thereby. The control unit 60 is a computer that, as shown in FIG. 5, includes a CPU 601, a communication I/F (Interface) sub-unit 602, a ROM (Read Only Memory) 603, a RAM (Random Access Memory) 604, and an image memory 605.

The communication I/F sub-unit 602 is an interface for connection to a LAN such as a LAN card or a LAN board. Programs are stored in the ROM 603, such as for controlling an engine control unit 80, an operation panel 6 and the power source unit 110.

The RAM 604 is used as a work area during execution of the programs by the CPU 601. The image memory 605 stores image data for printing input via the communication I/F sub-unit 602 and an image reading unit 7.

The CPU 601 controls the engine control unit 80, the operation panel 6 and the power source unit 110 and the like, by executing a corresponding program stored in the ROM 603. Through control of the power source unit 110, the control unit 60 controls allocation of power from the power source unit 110 to the drive load 130 (the image processing unit 3, the sheet feeder 4, the fan motor 90, the fixing device drive motor 54, the temperature sensor 53 and the image reading unit 7), the engine control load 140 (the engine control unit 80), and the heater 511. The control unit 60 controls allocation of power so as to not exceed a power rating of the printer 1 (1500 W in the present embodiment). The control unit 60 varies allocation of power based on an operation mode of the printer 1.

For example, when the printer 1 is in warming-up mode power may be allocated so that 1200 W of power is supplied to the heater 511 and the remaining 300 W of power is supplied to the drive load 130 and the engine control load 140. In warming-up mode the surface temperature of the heating roller 51 is lower than the target temperature required for fixing the unfixed toner image on the recording sheet (190° C. in the present embodiment), and the surface temperature is being increased towards the target temperature.

When the printer 1 is performing printing processing (referred to below as being in printing mode), power may be allocated so that 800 W of power is supplied to the heater 511, and the remaining 700 W of power is supplied to the drive load 130 and the engine control load 140. In printing mode, power supplied to the heater 511 is varied based for example on temperature within the printer 1 and the number of sheets to be printed. For example the power supplied to the heater 511 may be varied within a range of 400 W to 800 W.

When the printer 1 is in standby mode, power may be allocated so that 400 W of power is supplied to the heater 511 and the remaining 1100 W of power is supplied to the drive load 130 and the engine control load 140. In standby mode surface temperature of the heating roller 51 (for example 160° C. to 170° C.) is lower than the target temperature, but is maintained at a temperature so that the target temperature can be reached within seconds (two to three seconds for example) after the heater 511 is set to On. In standby mode, power supplied to the heater 511 is varied based for example on temperature within the printer 1. For example the power supplied to the heater 511 may be varied within a range of 0 W to 400 W.

When the printer 1 is in sleep mode (in other words when power supply to the heater 511 is suspended or restricted to at a low level for energy saving), power is allocated so that power is not supplied to the heater 511 or is supplied at a low level (no more than 200 W for example). If power is not supplied to the heater 511, power supply to the drive load 130 and the engine control load 140 is also suspended. If a low level of power is supplied to the heater 511, power is allocated so that the drive load 130 and the engine control load 140 are only supplied with power necessary to perform temperature control of the heater 511.

When the main switch 101 is set to On, the control unit 60 allocates sufficient power to the heater 511 for the printer 1 to transition to the warming-up mode, and controls the printer 1 to transition to the warming-up mode through the engine control unit 80. Once the warming-up operation is completed, if an execution instruction for a printing job is received through the operation panel 6 or the communication I/F sub-unit 602, the control unit 60 allocates power required for the printer 1 to transition to printing mode to the heater 511. The control unit 60 controls execution of printing processing to commence and the printer 1 to transition to the printing mode through the engine control unit 80. In contrast to the above, if an execution instruction for a printing job is not received once the warming-up operation is completed, the control unit 60 allocates power required for the printer 1 to transition to the standby mode to the heater 511. The control unit 60 controls the printer 1 to transition to the standby mode through the engine control unit 80, thus reducing power consumption.

Once the printer 1 has transitioned to standby mode, if an execution instruction for a printing job is not received within a predetermined period (30 minutes for example), the control unit 60 controls to suspend or reduce power supply to the heater 511 and to transition the printer 1 to the sleep mode through the engine control unit 80, thus further reducing power consumption.

The control unit 60 also controls operation of configuration elements related to the image forming operation through the engine control unit 80. The operation panel 6 includes a plurality of input keys and a liquid crystal display unit, the liquid crystal display unit having a touch panel layered on a front surface thereof. An instruction is received from a user through a touch input on the touch panel or a key input on any one of the input keys, and the instruction is notified to the control unit 60.

The engine control unit 80 performs overall control of the image forming operation through control of the image processing unit 3, the sheet feeder 4, the fan motor 90, the fixing device drive motor 54, the temperature sensor 53, the image reading unit 7, and the heater 511.

The engine control unit 80 is a computer that, as shown in FIG. 5, includes a CPU 801, a ROM 802, a RAM 803, and a back-up data memory 804. Programs for controlling the image processing unit 3, the sheet feeder 4, the fan motor 90, the fixing device drive motor 54, the temperature sensor 53, the image reading unit 7 and the heater unit 511 are stored in the ROM 802. A program for executing fixing device start-up heater control (explained in detail further below) is also stored in the ROM 802.

The RAM 803 is used as a work area during execution of programs by the CPU 801. The back-up data memory 804 stores therein various parameters which are required to set conditions for performing the image forming operation, a temperature decrease rate specifying table, a temperature increase rate specifying table, temperature estimation information and a threshold temperature.

The temperature decrease rate specifying table shows a relationship between a certain temperature range of surface temperature of the heating roller 51 and an amount of temperature decrease of the surface temperature per unit time (referred to below as a "temperature decrease rate") when the heater 511 is in a non-power supplied state. The above relationship is determined in advance, for example by a manufacturer of the printer 1 performing testing. FIG. 6 shows an example of the temperature decrease rate specifying table. As shown in FIG. 6, the temperature decrease rate tends to decrease gradually with decreasing surface temperature of the heating roller 51.

The temperature increase rate specifying table shows a relationship between a certain temperature range of surface temperature of the heating roller 51, a certain amount of power supplied to the heater 511, and a temperature increase rate of the surface temperature of the heating roller 51, when the amount of power is supplied to the heater 511. The above relationship is determined in advance, for example by the manufacturer of the printer 1 performing testing. FIG. 7 shows an example of the temperature increase rate specifying table. As shown in FIG. 7 the temperature increase rate is greatest when the surface temperature of the heating roller 51 is in a temperature range of 0° C. to 99° C. FIG. 7 also shows that the temperature increase rate increases in accordance with increasing power supply to the heater 511.

The temperature estimation information is information for estimating surface temperature of the heating roller 51 during the stabilization waiting period. More specifically, the temperature estimation information includes temperature information indicating surface temperature of the heating roller 51 at a time at which power supply to the heater 511 is suspended and time information indicating the time at which the power supply to the heater 511 is suspended.

Once the stabilization waiting period has passed, the engine control unit 80 acquires a detected surface temperature of the heating roller 51, detected by the temperature sensor 53, and a detection time corresponding to the detected temperature. The engine control unit 80 acquires the detected temperature and the detection time at regular intervals (for example every 10 seconds), and stores the detected temperature and the detection time in the back-up data memory 804 as present temperature estimation information. Each time the engine control unit 80 acquires a new detected temperature and a new detection time, the engine control unit 80 updates the present temperature estimation information to new temperature estimation information which includes the new detected temperature and the new detection time. In the fixing device start-up heater control (explained in detail below), the present temperature estimation information stored in the back-up data memory 804 when the power supply to the heater 511 is suspended, is used as most recent temperature estimation information. Situations when the power supply to the heater 511 may be suspended include (i) when the main switch 101 is set to Off, (ii) when an error occurs, such as a jam, and the control unit 60 enforces suspension of power supply from the power source unit 110 to the drive load 130, the engine control load 140 and the heater 511, and (iii) when the printer 1 transitions to sleep mode (if the printer 1 is of a type where power is not supplied to the heater 511 during sleep mode) and the control unit 60 suspends power supply from the power source unit 110 to the drive load 130, the engine control load 140 and the heater 511 during the transition to sleep mode. FIG. 8 shows an example of the temperature estimation information.

The threshold temperature is a threshold value for surface temperature of the heating roller 51, and is used in the fixing device start-up heater control as a criterion for judging whether the heater 511 should be set to On or Off during the stabilization waiting period. The threshold temperature is set in advance by the manufacturer to ensure that surface temperature of the heating roller 51 does not reach a temperature excessively higher than the target temperature during the stabilization waiting period, for example by considering a temperature increase rate of the heating roller 51 during the stabilization waiting period.

In order to effectively prevent excessive heating, the threshold temperature should preferably be set so that the target temperature is not exceeded during the stabilization waiting period. Also, in order to achieve shortening of the warming-up period, the threshold temperature should preferably be set as close to the target temperature as is possible without causing the target temperature to be exceeded during the stabilization waiting period.

For example, the threshold temperature may be set as explained below. Once temperature control of the heater 511 by the engine control unit 80 commences (once reading of the back-up data is completed), a time period from the temperature control commencing to the stabilization waiting period passing is, even at a maximum value, less than 760 milliseconds. Time between power supply commencing to the temperature sensor 53 and start-up of the main task for temperature control of the heater 511 is 240 milliseconds, therefore the time until the waiting period passes does not exceed 760 milliseconds (refer to FIG. 4). During the warming-up operation, if power supply (1200 W for example) is allocated to the heater 511 which is set to On, and the heating roller 51 is heated for 760 milliseconds, from the table in FIG. 7 it can be seen that a corresponding temperature increase rate is 20° C./s for the power supply of 1200 W. Therefore, over 760 milliseconds surface temperature of the heating roller 51 is estimated to increase by approximately 15° C.

In other words, even if the heating roller 51 is heated for the maximum time, corresponding to the maximum value described above, the surface temperature of the heating roller 51 does not increase by more than 15° C. Therefore, by setting the threshold temperature 15° C. below the target temperature (for example at 175° C. for a target temperature of 190°), and by setting the heater 511 to Off in the fixing device start-up heater control when an estimated surface temperature T of the heater roller 51 exceeds the target temperature, surface temperature of the heating roller 51 can be prevented from exceeding the target temperature during the stabilization waiting period. Heating time is lost if the heater 511 is needlessly set to Off while the surface temperature of the heating roller 51 is lower than the target temperature. By setting the heater 511 to On in all cases when the estimated surface temperature T does not exceed the threshold value, loss of heating time during the stabilization waiting period is reduced, thus allowing effective shortening of the warming-up period.

Returning to explanation of FIG. 5, by executing programs stored in the ROM 802, the CPU 801 performs control of the image processing unit 3, the sheet feeder 4, the fan motor 90, the fixing device drive motor 54, the temperature sensor 53, the image reading unit 7 and the heater 511 and the like, and also executes the fixing device start-up heater control.

The fan motor 90 is a motor for driving a ventilation fan (not illustrated) provided in the printer 1 in order to prevent temperature in the printer 1 from increasing. The engine control unit 80 controls driving of the fan motor 90.

The fixing device drive motor 54 is for rotationally driving the pressing roller 52 in the fixing device 5. Rotational drive of the pressing roller 52 causes rotation of the heating roller 51, coupled to the rotation of the pressing roller 52. Driving of the fixing device is controlled by the engine control unit 80. The image reading unit 7 includes an image input device such as a scanner, which reads information such as letters and diagrams from a recording sheet such as a paper sheet, and creates image data.

[5] Fixing Device Start-Up Heater Control

Figure 9:
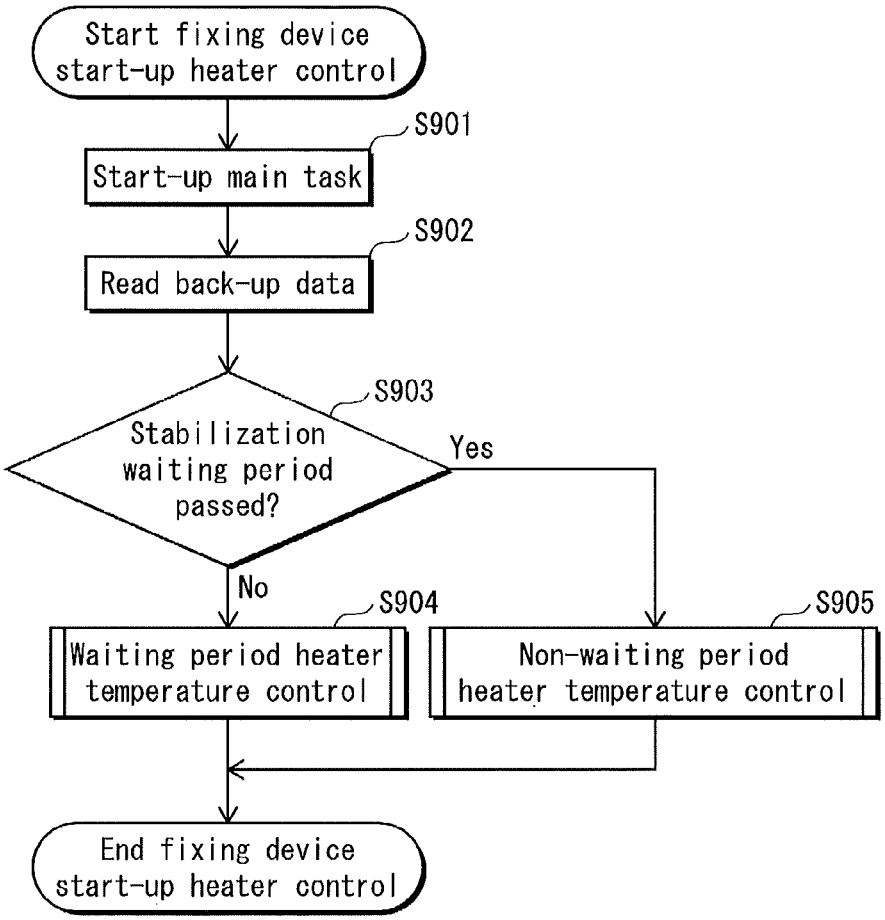
FIG. 9 is a flowchart showing a fixing device start-up heater control performed by an engine control unit 80.

FIG. 9 is a flowchart showing fixing device start-up heater control by the engine control unit 80. When suspension of power supply to the heater 511 is released due to a release event (for example an event such as the main switch 101 being set to On or a printing job being received while in sleep mode), the control unit 60 causes commencement of DC power supply to the drive load 130 and the engine control load 140, and AC power supply to the heater 511, through the power source unit 110. The engine control unit 80 reads a program for temperature control of the heater 511, starts-up a main task, and once start-up of the main task is completed, commences measuring time using a timer (Step S901).

Next, the engine control unit 80 commences reading of the back-up data stored in the back-up data memory 804, and measures a time t from start-up of the main task until completion of the reading of the back-up data (Step S902).

As shown in FIG. 4, in the present embodiment a time period of 240 milliseconds passes from the DC power supply commencing to the drive load 130 (start of the stabilization waiting period), until the engine control unit 80 completes start-up of the main task. Therefore, the engine control unit 80 judges whether the stabilization waiting period has passed at a time at which the reading of the back-up data is completed by judging whether the time t is at least 760 milliseconds (Step S903).

In the present embodiment, temperature control of the heater is performed in different forms depending on the above judgment as to whether the stabilization waiting period has passed at the time at which the reading of the back-up data is completed. The above is explained below in more detail.

When the stabilization waiting period is judged to have not passed (when the time t is less than 760 milliseconds) (Step S903: No), the engine control unit 80 performs a waiting period heater temperature control (Step S904). In contrast, when in Step S903 the stabilization waiting period is judged to have passed (when time t is at least 760 milliseconds) (Step S903: Yes), the engine control unit 80 performs a non-waiting period heater temperature control (Step S905). The waiting period heater temperature control and the non-waiting period temperature control are explained below in more detail.

Figure 10:
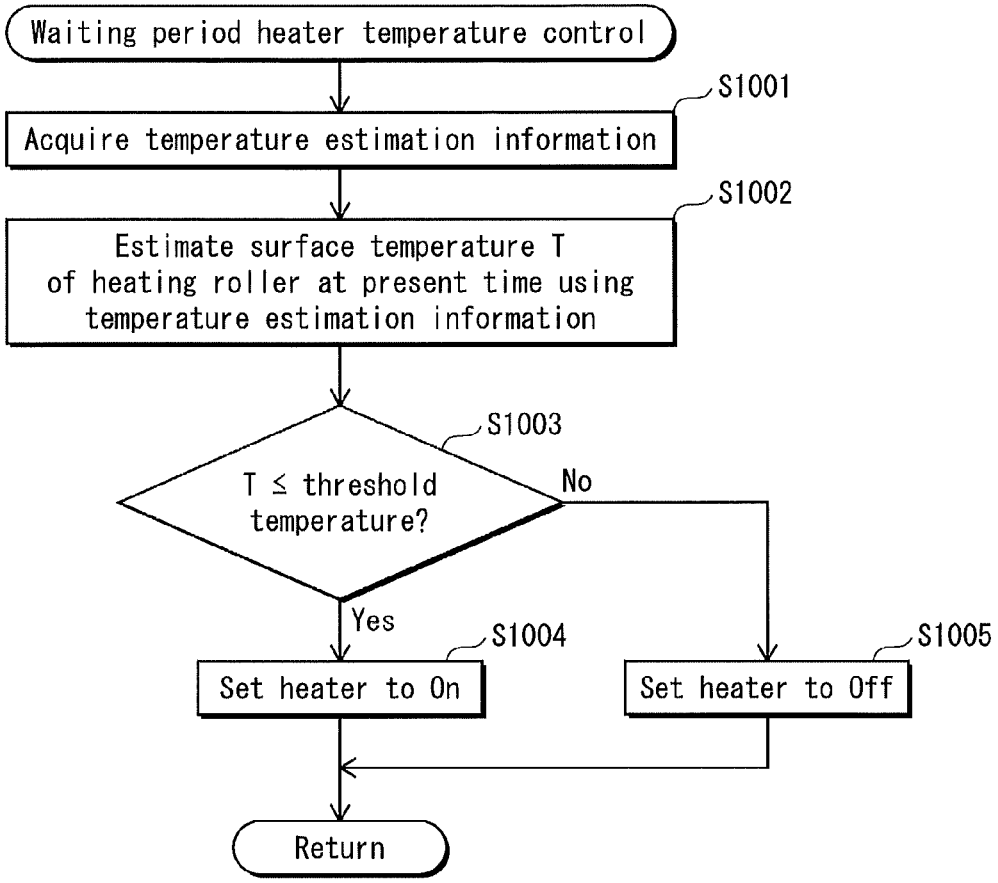
FIG. 10 is a flowchart showing a waiting period heater temperature control performed by the engine control unit 80.

FIG. 10 is a flowchart showing the waiting period heater temperature control performed by the engine control unit 80. The engine control unit 80 acquires most recent temperature estimation information stored in the back-up data memory 804 (Step S1001).

Based on the temperature estimation information, the engine control unit 80 estimates a surface temperature T of the heating roller 51 at a present time (Step S1002). The above estimation is performed as follows. The engine control unit 80 calculates an amount of time that has passed between a detection time indicated by the temperature estimation information and the present time. Also, the engine control unit 80 specifies a temperature decrease rate for a detected temperature of surface temperature of the heating roller 51 indicated by the temperature estimation information, by referring to the temperature decrease rate specifying table stored in the back-up data memory 804.

The engine control unit 80 calculates a temperature decrease amount for the amount of time that has passed by multiplying the amount of time that has passed by the specified temperature decrease rate. The engine control unit 80 estimates the surface temperature T of the heating roller 51 at the present time by subtracting the temperature decrease amount from the detected temperature indicated by the temperature estimation information.

Next, the engine control unit 80 judges whether the estimated surface temperature T for the heating roller 51 is no greater than the threshold temperature. If the surface temperature is judged to be no greater than the threshold temperature (Step S1003: Yes), the engine control unit 80 controls to set the heater 511 to On, and thus the heating roller 51 is heated by a predetermined power supply (the power supply of 1200 W allocated to the heater 511 during warming-up in the present embodiment). If the estimated surface temperature T is judged to exceed the threshold temperature (Step S1003: No), the engine control unit 80 controls to set the heater 511 to Off (Step S1005).

By performing a temperature control of the type described above, wherein the heater 511 is switched between On and Off based on whether the estimated surface temperature T is no greater than the threshold temperature, loss of heating time during the stabilization waiting period can be reduced while also ensuring that the heating roller 51 does not exceed the target temperature during the stabilization waiting period due to excessive heating.

As a result of the above, even though the temperature sensor 53 is not able to accurately measure surface temperature of the heating roller 51 during the stabilization waiting period, temperature control of the heating roller 51 can still be performed so that the heating roller 51 is not excessively or insufficiently heated during the stabilization waiting period. The above control allows shortening of time required for warming-up. Furthermore, due to prevention of excessive heating of the heating roller 51, excessive power consumption is prevented and thermal degradation of the heating roller 51, temperature sensor 53 and other proximal configuration elements, shortening lifetime thereof, is also prevented.

Figure 11:
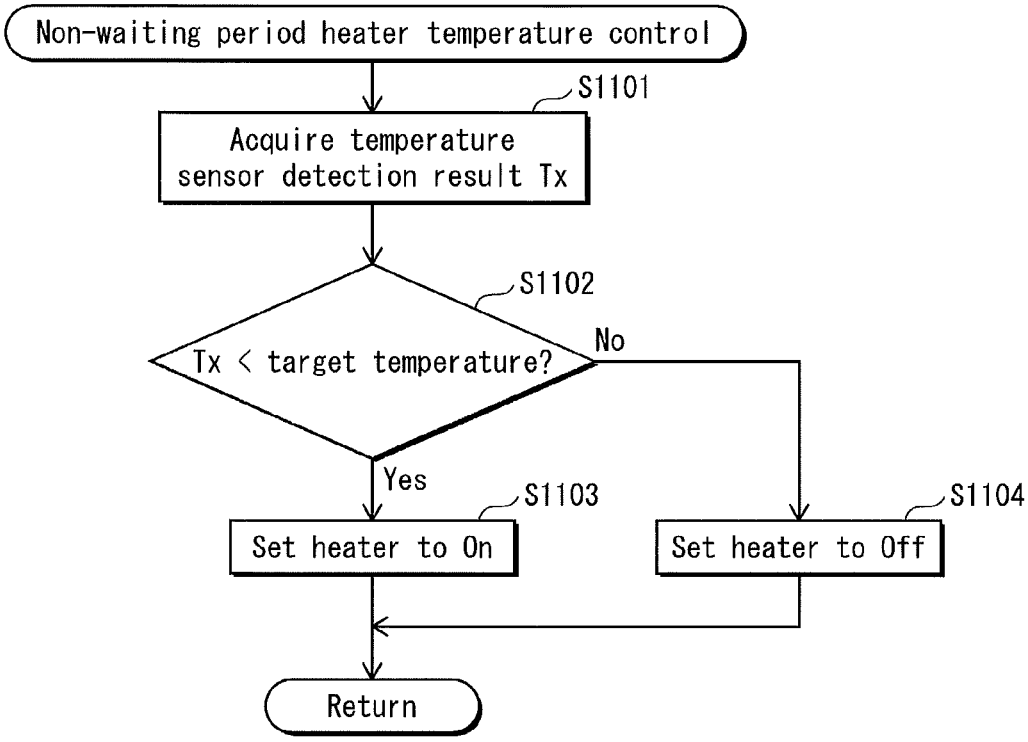
FIG. 11 is a flowchart showing a non-waiting period heater temperature control performed by the engine control unit 80.

The following describes the non-waiting period heater temperature control performed by the engine control unit 80. FIG. 11 is a flowchart showing the non-waiting period heater temperature control. The engine control unit 80 acquires a surface temperature $T_x$ of the heating roller 51 from a detection result of the temperature sensor 53 (Step S1101), and judges whether the surface temperature $T_x$ has reached the target temperature (Step S1102).

If the surface temperature $T_x$ is lower than the target temperature (Step S1102: Yes), the engine control unit 80 controls to set the heater 511 to On (S1103), and thus the heating roller 51 is heated by the power supply of 1200 W allocated to the heater 511 for during warming-up. If the surface temperature $T_x$ is not lower than the target temperature (Step S1102: No), the engine control unit 80 controls to set the heater 511 to Off (Step S1104).

Modified Examples

The present invention was explained above based on the embodiment, but the present invention is of course not limited by the embodiment. Alternatively, the present invention may be realized as described in modified examples below.

(1) In the embodiment, the temperature estimation information includes time information and temperature information, but alternatively the temperature estimation information may include only temperature information. For the above configuration, in Step S1002 shown in FIG. 10, the detected surface temperature of the heating roller 51 indicated by the temperature estimation information acquired by the engine control unit 80, is estimated to be the surface temperature T of the heating roller 51 at the present time. As a consequence of the above, the estimated surface temperature T is higher than an actual surface temperature of the heating roller 51 at the present time. However, as there is no possibility of the estimated surface temperature T being greater than the actual surface temperature, the waiting period heater temperature control in FIG. 10 can be performed without possibility of the heating roller 51 being excessively heated, causing surface temperature thereof to exceed the target temperature during the stabilization waiting period.

Furthermore, by setting the threshold temperature close to the target temperature as in the embodiment, even if the estimated surface temperature of the heating roller 51 is higher than the actual surface temperature at the present lime, so long as the estimated temperature does not exceed the threshold value, control can be performed to set the heater 511 to On. Thus, the warming-up period can be shortened.

(2) In the embodiment the temperature estimation information includes the temperature information, but alternatively any information that indicates surface temperature of the heating roller 51 may be used as the temperature estimation information.

For example, power supply information relating to an amount of power supply to the heater 511 may be stored in the back-up data memory 804 as the temperature estimation information each time power is supplied to the heater 511, the temperature estimation information being updated each time the power supply information is stored. For the above configuration, by setting a relationship between the amount of power supply and the estimated temperature T of the surface temperature of the heating roller 51, the waiting period heater temperature control can be performed in the same way as shown in FIG. 10. As a consequence of the above, even though the temperature sensor 53 cannot accurately measure surface temperature of the heating roller 51 during the stabilization waiting period, temperature control of the heating roller 51 can still be performed so that the heating roller 51 is not excessively or insufficiently heated during the stabilization waiting period. The above control allows effective shortening of time required for warming-up. Furthermore, due to prevention of excessive heating of the heating roller 51, excessive power consumption is prevented and thermal degradation of the heating roller 51, temperature sensor 53 and other proximal configuration elements, shortening lifetime thereof, is also prevented.

Alternatively, instead of using the power supply information as the temperature estimation information, mode information may be used relating to an operation mode of the printer 1, which indicates a power consumption state thereof.

Specifically, the mode information shows whether the printer 1 is in warming-up mode, standby mode, printing mode or sleep mode. The engine control unit 80 acquires the above mode information from the control unit 60 which controls transition between the different operation modes. The mode information is stored in the back-up data memory 804, and each time there is transition between different operation modes the mode information stored in the back-up memory 804 is updated to new mode information which indicates a mode which the printer 1 has transitioned to. Most recent mode information may be used as the temperature estimation information. For the above configuration, by setting a relationship between the operation mode indicated by the mode information and the estimated temperature T of the surface temperature of the heating roller 51, the waiting period heater temperature control can be performed in the same way as shown in FIG. 10.

(3) In the embodiment, in the fixing device start-up heater control shown in FIG. 9, once reading of the back-up data in Step S902 is completed, if the stabilization waiting period is judged to have not passed in Step S903, the waiting period heater temperature control is performed without exception. Alternatively, performance of the waiting period heater temperature control may be suspended in an exceptional situation, such as a situation where an error occurs in the image processing unit 3, and an image forming operation is suspended before completion.

Reasoning for the above is as follows. After an error occurs such as described above, if the fixing device is subsequently restarted, even after the warming-up operation is completed a cleaning operation controlled by the engine control unit 80 is still being performed on the image processing unit 3 to remove remaining toner. The above cleaning operation is performed by using the cleaner of each of the image creating sub-units 3Y, 3M, 3C and 3K, and the cleaner 21 positioned close to the driven roller 13. Therefore, an image forming operation cannot be commenced until the cleaning operation is completed. Control in an exceptional situation such as described above can be realized as follows.

In order to detect errors, sensors are provided in the image processing unit 3. For example, a jam sensor, a rotation detection sensor for detecting rotation of the drive motor and a photoelectric sensor for detecting a light amount of the light exposure sub-unit 10 are provided. When an error (for example a jam, a suspension of the drive motor or an anomalous light amount) is detected by any one of the sensors, the control unit 60 is notified that the error is detected via the engine control unit 80. In response to the error notification, the control unit 60 suspends power supply from the power source unit 110 to the drive load 130, the engine control load 140 and the heater 511. Also, the control unit 60 causes error information indicating that the error has occurred to be stored in the back-up data memory 804 of the engine control unit 80. The error information is deleted by the engine control unit 80 once the cleaning operation is completed.

Figure 12:
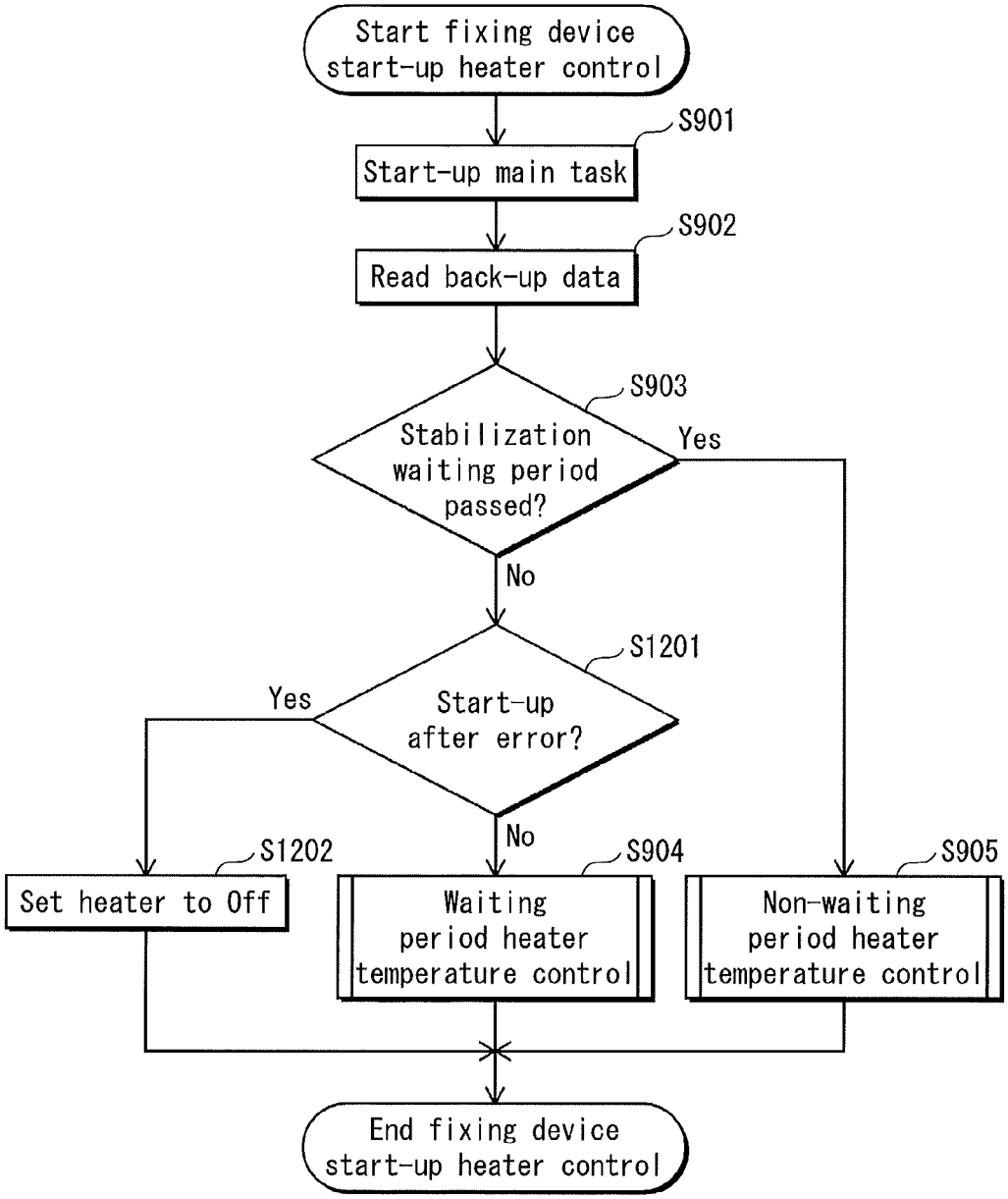
FIG. 12 is a flowchart showing a modified example of the fixing device start-up heater control performed by the engine control unit 80.

As shown in FIG. 12, the engine control unit 80 performs a modified version of the fixing device start-up heater control shown in FIG. 9. Steps in FIG. 12 which are identical to steps in FIG. 9 are labeled using the same reference symbols as in FIG. 9. The modified version of the fixing device start-up heater control is explained below with reference to FIG. 12, focusing on differences compared to the fixing device start-up heater control in FIG. 9. If the stabilization waiting period is judged not to have passed in Step S903 (Step S903: No), the engine control unit 80 judges whether the fixing device is being started-up after an error such as described above, based on whether error information is stored in the back-up data memory 804 (Step 1201). If the fixing device is judged to be being started-up after an error (Step 1201: Yes), the engine control unit 80 suspends performance of the waiting period heater temperature control and sets the heater 511 to Off (Step S1202) until the stabilization waiting period has passed (Step S903: Yes).

Through the above configuration, the waiting period heater temperature control is suspended when unnecessary, and thus overall efficiency of the fixing device start-up heater control is improved.

SUMMARY

One aspect of the present invention disclosed above is an image forming apparatus, comprising: a fixing device configured to thermally fix, through use of a heating member, an unfixed image formed on a recording sheet; a non-contact temperature sensor configured to commence measuring temperature of the heating member once a waiting period of a certain length has passed after power supply commences to the fixing device; an acquiring unit configured to each time the fixing device transitions to a non-power supplied state, acquire information indicating a heating condition of the heating member at the time the fixing device transitions to the non-power supplied state; and a fixing control unit configured to perform a non-waiting period control once the waiting period has passed and a waiting period control during the waiting period, the non-waiting period control being controlling to increase temperature of the heating member, while monitoring temperature of the heating member using the non-contact temperature sensor, until a target temperature is reached at which thermal fixing can be performed, and the waiting period control being estimating temperature of the heating member at a present time using most recent information acquired by the acquiring unit, and when the estimated temperature does not exceed a threshold temperature, controlling to increase temperature of the heating member, and when the estimated temperature exceeds the threshold temperature, controlling to prevent increase of temperature of the heating member.

The information may include temperature of the heating member at the time the fixing device transitions to the non-power supplied state, and in the waiting period control, temperature of the heating member at the present time may be estimated based on temperature of the heating member included in the most recent information. The information may further include a time at which the fixing device transitions to the non-power supplied state, and in the waiting period control, temperature of the heating member at the present time may be estimated based on temperature of the heating member included in the most recent information and an amount of time passed since the time included in the most recent information.

Alternatively, the information may indicate an amount of power supply to the heating member directly prior to the time the fixing device transitions to the non-power supplied state, and in the waiting period control, temperature of the heating member at the present time may be estimated based on the amount of power supply indicated by the most recent information.

Alternatively, the information may indicate a power consumption state of the heating member directly prior to the time the fixing device transitions to the non-power supplied state, and in the waiting period control, temperature of the heating member at the present time may be estimated based on the power consumption state indicated by the most recent information. The non-contact temperature sensor may be a thermopile.

In the above configuration, the non-contact temperature sensor is configured to commence measuring temperature of the heating member once a waiting period of a certain length has passed after power supply commences to the fixing device. However, control of temperature of the heating member can be performed by estimating temperature of the heating member at the present time based on the information indicating the heating condition of the heating member at the time the fixing device transitions to the non-power supplied state, thus increase of temperature of the heating member can be appropriately controlled even during the waiting period.

An effect of the above configuration is that increase of temperature of the heating member can be controlled so as to not be excessive or insufficient. When the estimated temperature does not exceed the threshold temperature, temperature of the heating member can be controlled to increase during the waiting period, thus shortening the warming-up period of the heating member. When the estimated temperature exceeds the threshold temperature, increase of the temperature of the heating member can be prevented during the waiting period, thus preventing overheating of the heating member.

The image forming apparatus may further comprise: an image processing unit configured to form a toner image on an image carrier and transfer the toner image onto a transfer member; a detection unit configured to detect an error occurring in the image processing unit; a suspension unit configured to suspend power supply to the image processing unit and the fixing device when the error is detected; and a cleaning unit configured to, when suspension of the power supply by the suspension unit is released, perform cleaning of the image processing unit before an image formation operation commences, wherein when suspension of the power supply by the suspension unit is released and subsequently power supply to the fixing device commences, the fixing control unit may suspend performance of the waiting period control.

In the above configuration, when the error occurs in the image processing unit, power supply to the fixing device is suspended. Subsequently, when suspension of power supply to the fixing device is released, the cleaning operation is performed before the image formation operation commences. Thus, even if the warming-up period of the heating member is shortened, the image formation operation cannot be commenced until after the cleaning operation is completed. In the above case, performance of the waiting period control is suspended after the error has occurred. Consequently, unnecessary performance of the waiting period control can be prevented.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus, comprising:

a fixing device configured to thermally fix, through use of a heating member, an unfixed image formed on a recording sheet;

a non-contact temperature sensor configured to commence measuring temperature of the heating member once a waiting period of a certain length has passed after power supply commences to the fixing device;

an acquiring unit configured to each time the fixing device transitions to a non-power supplied state, acquire information indicating a heating condition of the heating member at the time the fixing device transitions to the non-power supplied state; and a fixing control unit configured to perform a non-waiting period control once the waiting period has passed and a waiting period control during the waiting period, the non-waiting period control being controlling to increase temperature of the heating member, while monitoring temperature of the heating member using the non-contact temperature sensor, until a target temperature is reached at which thermal fixing can be performed, and the waiting period control being estimating temperature of the heating member at a present time using most recent information acquired by the acquiring unit, and when the estimated temperature does not exceed a threshold temperature, controlling to increase temperature of the heating member, and when the estimated temperature exceeds the threshold temperature, controlling to prevent increase of temperature of the heating member.

2. The image forming apparatus in claim 1, wherein the information includes temperature of the heating member at the time the fixing device transitions to the non-power supplied state, and in the waiting period control, temperature of the heating member at the present time is estimated based on temperature of the heating member included in the most recent information.

3. The image forming apparatus in claim 2, wherein the information further includes a time at which the fixing device transitions to the non-power supplied state, and in the waiting period control, temperature of the heating member at the present time is estimated based on temperature of the heating member included in the most recent information and an amount of time passed since the time included in the most recent information.

4. The image forming apparatus in claim 1, wherein the information indicates an amount of power supply to the heating member directly prior to the time the fixing device transitions to the non-power supplied state, and in the waiting period control, temperature of the heating member at the present time is estimated based on the amount of power supply indicated by the most recent information.

5. The image forming apparatus in claim 1, wherein the information indicates a power consumption state of the heating member directly prior to the time the fixing device transitions to the non-power supplied state, and in the waiting period control, temperature of the heating member at the present time is estimated based on the power consumption state indicated by the most recent information.

6. The image forming apparatus in claim 1, further comprising an image processing unit configured to form a toner image on an image carrier and transfer the toner image onto a transfer member;

a detection unit configured to detect an error occurring in the image processing unit;

a suspension unit configured to suspend power supply to the image processing unit and the fixing device when the error is detected; and a cleaning unit configured to, when suspension of the power supply by the suspension unit is released, perform cleaning of the image processing unit before an image formation operation commences, wherein when suspension of the power supply by the suspension unit is released and subsequently power supply to the fixing device commences, the fixing control unit suspends performance of the waiting period control.

7. The image forming apparatus in claim 1, wherein the non-contact temperature sensor is a thermopile.

* * * * *